US011445583B2

(12) United States Patent
Luo et al.

(10) Patent No.: US 11,445,583 B2
(45) Date of Patent: Sep. 13, 2022

(54) LIGHTING APPARATUS

(71) Applicant: XIAMEN ECO LIGHTING CO. LTD., Xiamen (CN)

(72) Inventors: Tong Luo, Xiamen (CN); Lei Zhang, Xiamen (CN); Yongzhe Dong, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/363,575

(22) Filed: Mar. 25, 2019

(65) Prior Publication Data

US 2020/0314977 A1 Oct. 1, 2020

(51) Int. Cl.

| | |
|---|---|
| ***H05B 45/20*** | (2020.01) |
| ***H05B 45/14*** | (2020.01) |
| ***H05B 47/18*** | (2020.01) |

(52) U.S. Cl.

CPC ..... *H05B 45/20* (2020.01); *H05B 45/14* (2020.01); *H05B 47/18* (2020.01)

(58) Field of Classification Search

CPC ..... H05B 33/0863; H05B 37/0254

See application file for complete search history.

(56) References Cited

U.S. PATENT DOCUMENTS

2018/0042092 A1* 2/2018 Bowser ..... H05B 47/18

* cited by examiner

*Primary Examiner* — Seokjin Kim
*Assistant Examiner* — Jianzi Chen
(74) *Attorney, Agent, or Firm* — Chun-Ming Shih; Lanway IPR Services

(57) ABSTRACT

A Lighting apparatus includes a driver box and a lighting module. The driver box includes a box housing, a driver circuit, and at least two manual switches. The manual switches are operable for setting at least two parameter values. The lighting module includes multiple LED modules and a lighting housing. The multiple LED modules are electrically coupled to the driver circuit of the driver box for receiving the driving current and for emitting a output light adjusted in response to operation of the two manual switches.

25 Claims, 7 Drawing Sheets

LIGHTING APPARATUS

FIELD

The present invention is related to a lighting apparatus and more particularly related to controlling of a lighting apparatus.

BACKGROUND

LED lighting devices keep developing quickly. More and more traditional lighting devices are now replaced with LED lighting devices.

LED (Light Emitted Diode) modules have many advantages, but it is also challenging to design a more convenient, lower cost solution to make human life better. This is particularly attractive and beneficial because the lighting products are in a crowded art and often have large amount of sales around the world.

SUMMARY OF INVENTION

In some embodiments, a Lighting apparatus includes a driver box and a lighting module.

The driver box includes a box housing, a driver circuit, and at least two manual switches. For example, the box housing is a one-piece component of rectangular shape, a cylinder shape, a disk shape, a polygonal shape or any other shape as a container for storing the driver circuit. Some structures like opening holes, guiding structures, grooves may be disposed for placing wiring of external power source to the driver circuit.

The driver box may be made of a component or integrated with multiple components. There may be an openable cover for setting wire connection for the driver circuit to an external power source. By opening the openable cover, users may also set connection between the driver circuit with the lighting module.

The driver box may be made of metal material for preventing fire accident, and may be made of plastic material for decreasing cost and preventing electrical shock.

In some embodiments, the driver circuit is partly or completely stored in the box housing. For example, the lighting module may have its own part of driving components like filters, logic control circuits, wireless circuits. In some other embodiments, all driver components are placed in the driver box for simplifying design of lighting devices.

There are at least two manual switches, e.g. two manual switches, three manual switches or more manual switches.

The manual switches are operable by users for setting at least two parameter values. For example, the manual switch may have a sliding structure, a rotatable structure, a button structure, a touch interface or other activation, switching, adjusting mechanical and/or electrical switches. The manual switches may contain multiple types of manual switches at the same time. For example, the manual switches may contain a button and a slider at the same time for adjusting different corresponding functions.

The manual switches are used for adjusting two or more parameter values corresponding to two or more operating attributes of the driver circuit for the driver circuit to generate a corresponding driving current.

The parameter values may be directly or indirectly corresponding to the operating attributes. For example, one of the parameter values may be a value from multiple candidate values for indicating a mode from multiple candidate modes. When users operate the manual switch setting the parameter value, the driver circuit receives the parameter value and then translates the parameter value to one or more than one corresponding driver signals, to change working modes, to switch to another look-up tables for generating multiple sub-currents to multiple LED modules respectively for achieving different color temperatures, different colors, or to adjust one or more operation parameters. The affected parameters, with some examples mentioned above, based on which the driver circuit work are operating attributes of the driver circuit. Other behaviors may also be corresponded depending on design needs.

Other operating attributes may include, but not limited to, input voltages, input currents, output voltages, output currents, output duty ratios in PWM (Pulse Width Modulation), working modes, color temperatures, colors, light spectrums, blue light elimination, volume controls of a speaker integrated in the lighting module, luminance level or other direct or indirect attributes of the working behavior of the driver circuit and/or the lighting module.

The lighting module includes multiple LED modules and a lighting housing. The multiple LED modules are stored in the lighting housing. For example, the multiple LED modules are placed on a light source plate, a circular wall associated with a light guide component for guiding lights to desired output direction, one or more rigid or flexible elongated substrates as filament styles.

The multiple LED modules may be the same types or include multiple types. For example, the multiple LED modules may include red, blue, green LED modules. Furthermore, the multiple LED modules may include one type or more types of white LED modules. These LED modules may be operated exclusively, i.e. when a first set of LED modules are activated, the second set of LED modules are deactivated. In some other embodiments, all LED modules of different types are activated at the same time but with different light strengths for mixing different output lights.

The multiple LED modules are electrically coupled to the driver circuit of the driver box for receiving the driving current and for emitting a output light adjusted in response to operation of the at least two manual switches. Users may operate the two manual switches for adjusting the output light for meeting their needs.

When the lighting modules are installed in a cavity of a ceiling, the driver box is stored inside the cavity of the ceiling. In such case, even the manual switches are not easily operated unless the lighting module are detached from the cavity for exposing the manual switches to operate, there is still advantage for such design. For example, in a shopping mall, different color temperature types of lighting devices may be provided at the same time so that users may choose their desired types of lighting devices, e.g. a white light devices or a yellow light devices. With such design, users with different needs may buy the same type of light devices. What they need to do is to operate the manual switches to change the behavior of the lighting devices before installing the light devices to a ceiling.

Furthermore, lighting devices, particularly with LED modules, may have a long life span. People, in a factory, a store, or at home, may want to change their environment design, e.g. relocating spaces. In such case, they can use the old but well working lighting devices, and operate the manual switches for changing the behavior of the lighting devices.

In some embodiments, the lighting housing may include a panel frame defining a light opening for emitting the output light. In such case, the light module may be a rectangular, a circular, a polygonal shape of a panel light. To make the panel light thinner, a light guide may be used while LED modules emitting light into a lateral wall of the light guide and the light is directed to emit outside the light guide to produce a soft and comfortable light source.

In some embodiments, one of the manual switches is used for setting a color temperature of the output light. For example, the manual switch may be used for selecting one from several candidate values, e.g. morning light, sunset light, noon light, cold light, warm light corresponding to different color temperatures, as well as light strengths.

In some embodiments, one of the manual switches is used for setting a current value of the driving current supplied to the LED modules. The current value may include multiple sub-values for driving different LED modules respectively. These sub-values may be scaled at the same ratio or at different ratios. For example, there are two types of LED modules in the lighting module. When an overall driving current is increased, the first type of LED module may have a larger increasing ratio than the second type of LED module. With such design, the light characteristic is changed while the overall luminance level is changed.

In some embodiments, the luminance level of the output light is increased or decreased in response to one of the parameters. Specifically, such setting achieves a similar dimming function that is commonly used in current lighting design.

In some embodiments, one of the manual switches is used for setting a mixed color value of the output light. For example, when the LED modules include multiple colors, by changing luminance levels of these colors, a mixed color is obtained for satisfying different needs of users.

For example, in birthday parties, or Christmas holidays, a housing or a store may be decorated with different colors in that time period but may be restored to normal lighting setting when the holiday season is over. Such design provides a flexible and convenient use of lighting devices.

In some embodiments, an openable cover may be used for concealing the manual switches when the openable cover is closed. Such openable cover may have a sliding structure, a detachable structure, a rotatable structure or any other structure so that users may open and close the cover for exposing the manual switches to operate or for concealing the manual switches.

In some embodiments, one of the manual switches is a mode indicator for indicating one operating attribute from multiple operating attributes, and another manual switch is operated for changing the parameter value of the indicated operating attribute.

Specifically, two manual switches may be used for corresponding to different parameter value settings. Alternatively, one manual switch may be used for indicating which parameter value is to be corresponded. In such design, two manual switches may be used for setting more than two parameter values. For example, the first manual switch may be slided for selecting 10 setting modes indicating one from 10 parameter values to be adjusted by the other manual switch.

In some embodiments, more than three operating attributes are adjustable via the manual switches. As mentioned, more than two manual switches may be disposed on the driver box. Furthermore, these manual switches may have the same types or different types.

In some embodiments, the driver box is connected to the lighting module via a detachable connector. For example, detachable connector may contain multiple power wires for supplying electricity and control wires for transmitting control signals. In some other case, the driver box may be mounted directly on the light module or even integrated with the lighting housing of the lighting module. For example, such design may be used in downlight design.

In some embodiments, the driver box has multiple operating modes corresponding to different types of the lighting module. The same driver box may be used in different types of lighting modules. When different lighting modules are connected, the driver circuit may have different corresponding settings. With the manual switch for selecting corresponding configuration, the design may be simplified, e.g. the driver circuit does not need to reply on electronic detection of the lighting module for providing a corresponding driving current. In addition, when the driver circuit is configured to map to different types of lighting modules, more functions may be designed for one lighting module without interference with other lighting module.

In some embodiments, each manual switch corresponds to a different operating attribute when the driver box is connected to a different type of the light module. The driver circuit may determine the type of lighting module by auto detection or via the manual switch as mentioned above. In some embodiments, the manual switches may correspond to different parameter values associated with different operating attributes.

In some embodiments, the driver circuit in the driver box supplies power to multiple lighting modules. Specifically, multiple lighting modules may share the same driver circuit to decrease cost and/or decrease installation difficulty. In such case, the manual switch may indicate corresponding connection of the multiple lighting modules.

In some embodiments, the manual switch indicates a number of lighting modules being connected to the driver box. With such design, the driver circuit may provide different corresponding voltages and/or currents to the lighting modules. In some embodiments, a constant current source is disposed in the driver circuit and the overall current value may be adjusted depending on different number of lighting modules being connected to the driver circuit.

In some embodiments, the driver circuit works with another driver circuit in another driver box, and the parameter value indicates a working parameter with said another driver circuit. For example, multiple driver circuits may work together for supplying currents to LED modules. In some embodiments, some driver circuit may be kept in sleep and standby mode, and activated when necessary, e.g. a larger luminance level is requested. Such design may also be used for providing a backup mechanism so that when one driver circuit is out of order, the other driver circuit may provide temporary and backup function for keeping light modules to function normally or function with least capability.

In some embodiments, the driver circuit may include a detector for detecting a type of the light module and configures a corresponding mapping between the operating attributes and the manual switches according to the type of lighting module.

In such design, the driver circuit determines a current type of lighting module, different functions may be assigned to the same manual switch.

In some embodiments, even a manual switch is corresponding to color temperature adjustment, but the corresponding driving manners may be different when connecting to different lighting modules. For example, in a first mode, the manual switch corresponds adjustment of red, green and blue LED modules for adjusting color temperature of the output light. In a second mode, the same manual switch corresponds adjustment of two white LED modules with different color temperatures.

In some embodiments, the lighting apparatus may include a communication circuit for receiving an external command for adjusting the output light. For example, the communication circuit may implement Wi-Fi, Bluetooth, Zig-Bee or other IoT protocols for receiving and/or transmitting messages from and to an external remote control device, a server or a mobile phone. The parameter value is combined with the external command for determining a characteristic of the output light.

In some embodiments, the lighting apparatus may be provided with a replaceable unit to be detachably attached to the lighting module for adjusting the output light in different manners. For example, the replaceable unit may be a lens module. Different lens modules providing different light beam patterns may be provided to users so that users may replace a proper lens module when needed. In such case, the manual switches are used for driving the LED modules corresponding to the replaceable unit. For example, when a lens module with a focus mode is used, some LED modules are turned off, when in other case, another lens module with a wider beam angle is used, all LED modules are turned on.

In some embodiments, the replaceable units may be multiple lens set for producing light beams with different beam angles.

In some embodiments, the manual switches are corresponded to disable a function of the lighting module, instead of activating corresponding functions of the lighting module. For example, a speaker may be activated or de-activated by operating the manual switch.

In some embodiments, the LED modules of the lighting module include two white light LED modules with different color temperatures.

In some embodiments, the LED modules of the lighting module may include a red LED module, a blue LED module and a green LED module.

In some embodiments, the two white light modules, the red module, the blue module and the red module are packaged together as a package unit receiving the driving current from the driver circuit. Different packaging styles may be used for providing different integrated manner of different LED modules.

In some embodiments, at least one of the manual switches provide continuous adjusting of corresponding parameter value. Specifically, instead of discrete settings, a continuous value is set. For example, a parameter value between 0 to 1 is set with a manual switch, and in such case, 0.05, 0.93, 0.74, 0.5 or other arbitrary value may be set.

In some embodiments, the continuous adjusting is for light dimming of the output light.

In some embodiments, at least one of the manual switches provide segmental adjusting of corresponding parameter value. Segmeral adjusting, compared with continuous adjusting, provides multiple discrete values to be selected therefrom.

DETAILED DESCRIPTION

Figure 1:
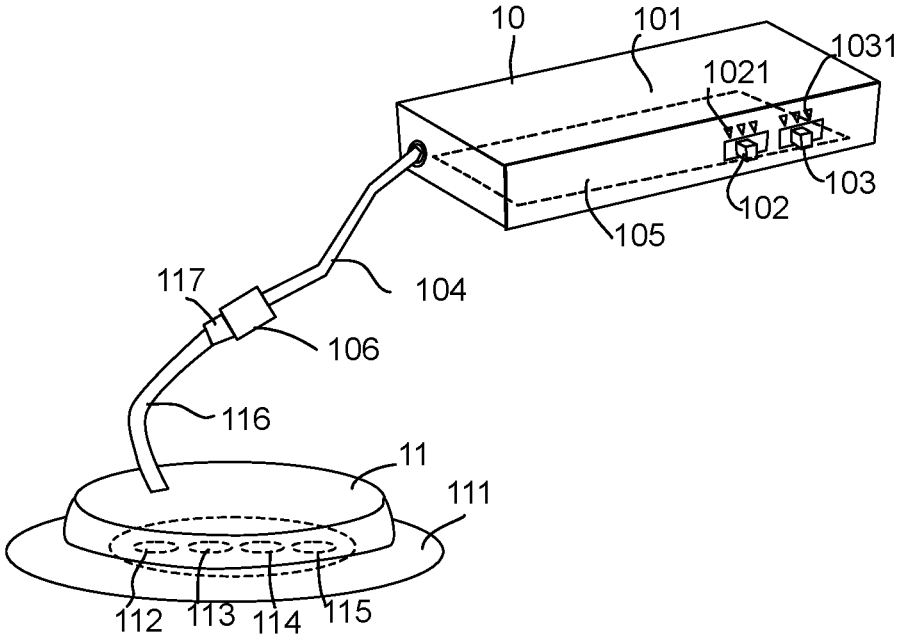
FIG. 1 illustrates an embodiment of a lighting apparatus that has a driver box and a lighting module.

Please refer to FIG. 1, which is an embodiment of a lighting apparatus. The lighting apparatus includes a driver box 10 and a lighting module 11. The driver box 10 includes a driver circuit 105 contained in a box housing 101. The driver box 10 also has two manual switches 102, 103, operable for selecting two or more parameter values 1021, 1031.

The driver circuit 105 receives the parameter values 1021, 1031 to operate accordingly. The driver circuit 105 is electrically connected to a wire 104 that has a first terminal 106. The first terminal 106 is further connected to a second terminal 117 that is connected to a wire 116. The wire 116 is further connected to a light source plate mounted with four LED modules 112, 113, 114, 115. In this example, the four LED modules 112, 113, 114, 115 are a red LED module, a green LED module, a blue LED module and a white LED module 115.

The LED modules 112, 113, 114, 115 are stored in a lighting housing 111 as a component of the lighting module 11.

The first terminal 106 and the second terminal 117 are detachably connected so that they can be detached and connected when needed. In other words, the same driver box 10 may be connected to another lighting module, if the lighting module is supported by the driver circuit 105.

Figure 2A:
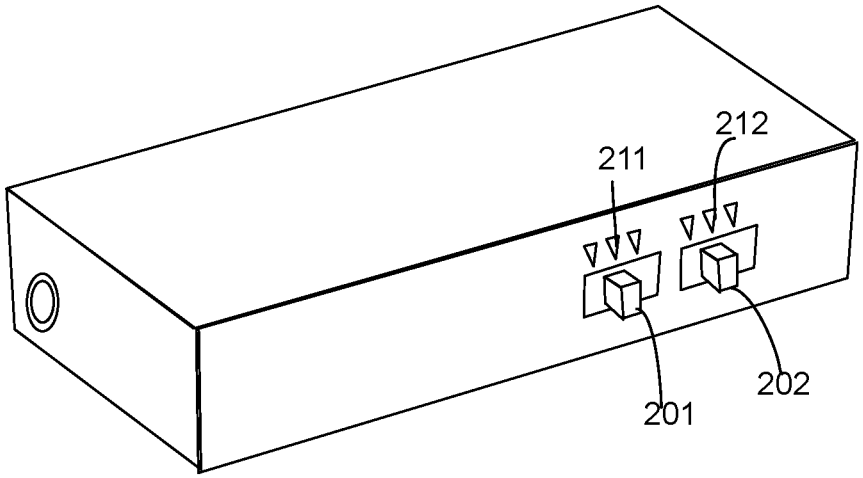
FIG. 2A illustrates a first operation status of an embodiment.
Figure 2B:
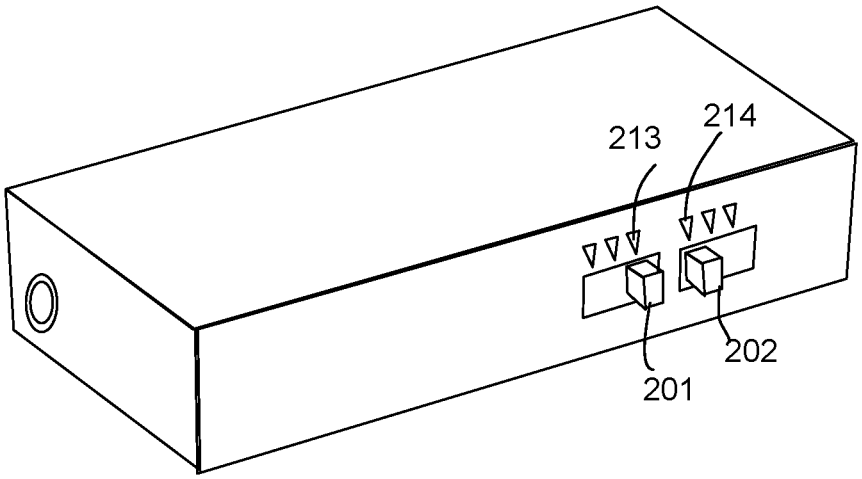
FIG. 2B illustrates a second operation status of the embodiment in FIG. 2A.

Please refer to FIG. 2A and FIG. 2B, which illustrate two operating statuses of a driver box.

In FIG. 2A, the two manual switches 201, 202 are respectively set to parameter values 211, 212.

In FIG. 2B, the two manual switches 201, 202 are slided to two different parameter values 213, 214.

Figure 3A:
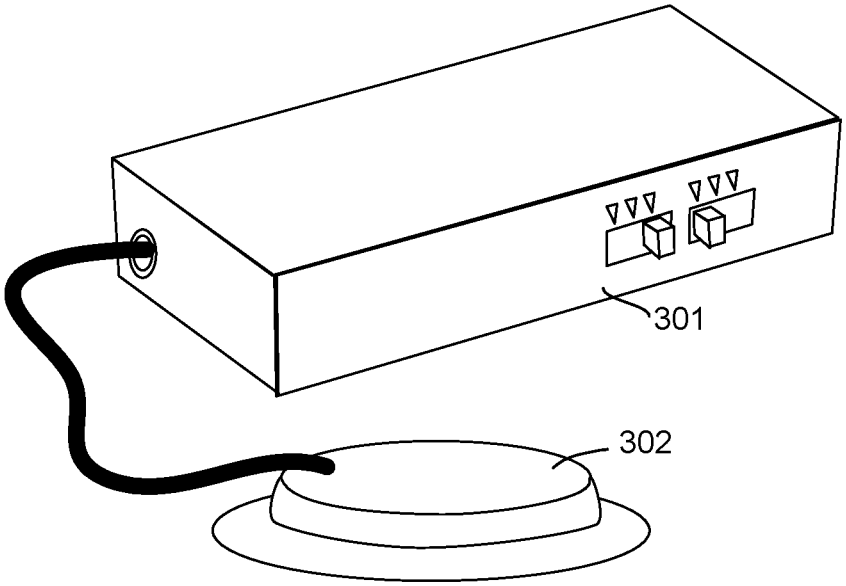
FIG. 3A illustrates a driver box connecting to a downlight lighting module.
Figure 3B:
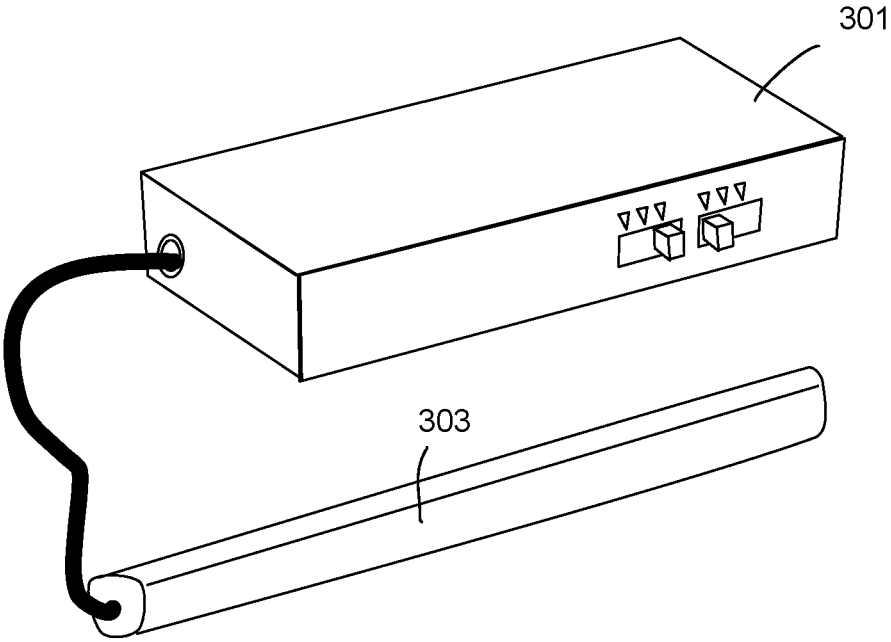
FIG. 3B illustrates the driver box in FIG. 3A connecting to a light tube module.

Please refer to FIG. 3A and FIG. 3B, which illustrate the same driver box 301 can be connected to different lighting modules 302, 303. In FIG. 3A, the driver box 301 is connected to a downlight lighting module 302. In FIG. 3B the driver box 301 is connected to a light tube module 303.

Figure 4:
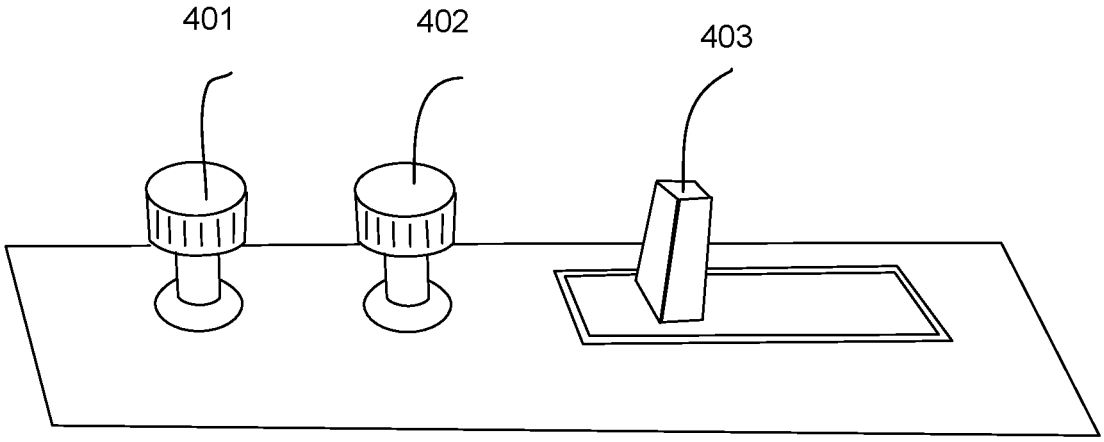
FIG. 4 illustrates three manual switches as an example.

Please refer to FIG. 4, which illustrate three manual switches with different types are disposed on a driver box. In FIG. 4, two rotating manual switches 401, 402 are used for providing rotatable manual operation while another manual switch 403 may be slided for changing three different parameter values respectively.

In some embodiments, a Lighting apparatus includes a driver box and a lighting module.

Figure 5A:
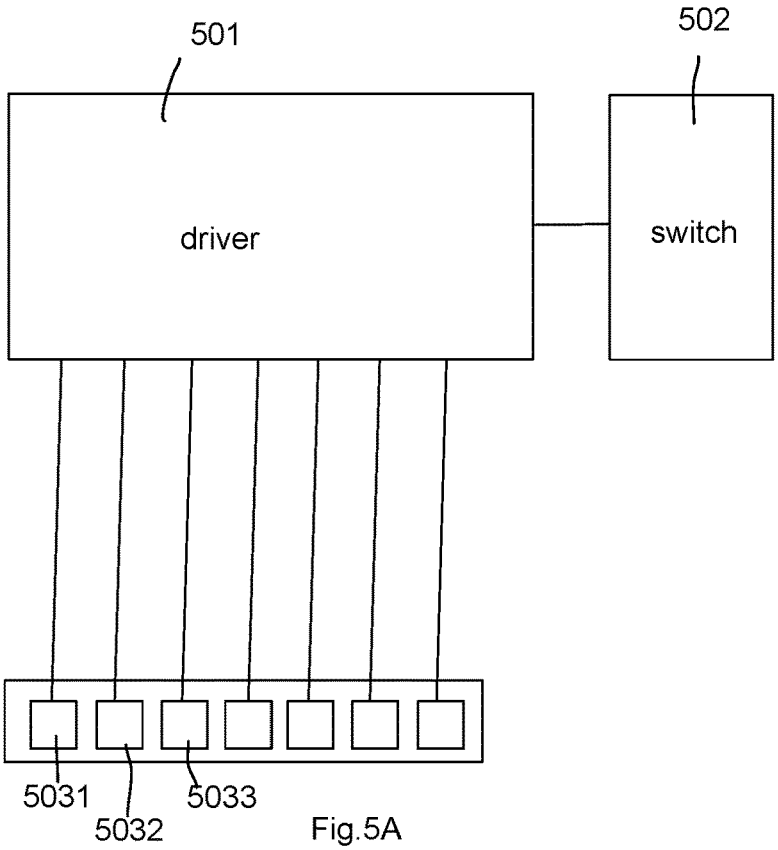
FIG. 5A illustrates a connection diagram of components in a driver box.

Please refer to FIG. 5A, which illustrate a diagram showing logical combination in a driver box.

In FIG. 5A, the driver 501 contains driver circuit components receive parameter via mechanical or electronic types of manual switches 502. The driver 501 supply driving currents to multiple LED modules 5031, 5032, 5033.

Figure 5B:
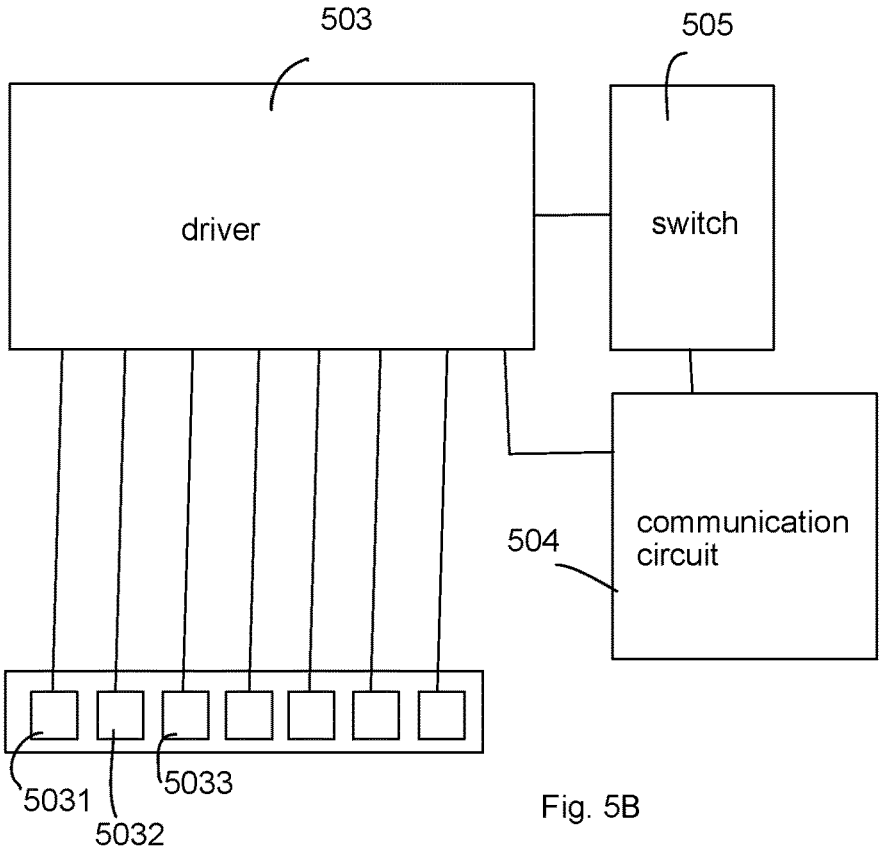
FIG. 5B illustrates another connection diagram of components in a driver box.

Please refer to FIG. 5B, which illustrates a diagram of another embodiment. In FIG. 5B, the driver 503 is connected to a switch 505 that may contain multiple manual switches as mentioned above. In addition, the switch 505 is further connected to a communication circuit 504. The driver 503 supplies driving current to the LED modules 5031, 5032, 5033. The communication circuit 504 may receive an external command from an IoT (Internet of Things) gateway, a remote control or a mobile phone.

The parameter values of the switch 505 are also supplied to the communication circuit 504 for informating a behavior of the communication circuit 504, which may be a wireless circuit or a wire circuit for transmitting electronic messages.

The driver box includes a box housing, a driver circuit, and at least two manual switches. For example, the box housing is a one-piece component of rectangular shape, a cylinder shape, a disk shape, a polygonal shape or any other shape as a container for storing the driver circuit. Some structures like opening holes, guiding structures, grooves may be disposed for placing wiring of external power source to the driver circuit.

The driver box may be made of a component or integrated with multiple components. There may be an openable cover for setting wire connection for the driver circuit to an external power source. By opening the openable cover, users may also set connection between the driver circuit with the lighting module.

The driver box may be made of metal material for preventing fire accident, and may be made of plastic material for decreasing cost and preventing electrical shock.

In some embodiments, the driver circuit is partly or completely stored in the box housing. For example, the lighting module may have its own part of driving components like filters, logic control circuits, wireless circuits. In some other embodiments, all driver components are placed in the driver box for simplifying design of lighting devices.

There are at least two manual switches, e.g. two manual switches, three manual switches or more manual switches.

The manual switches are operable by users for setting at least two parameter values. For example, the manual switch may have a sliding structure, a rotatable structure, a button structure, a touch interface or other activation, switching, adjusting mechanical and/or electrical switches. The manual switches may contain multiple types of manual switches at the same time. For example, the manual switches may contain a button and a slider at the same time for adjusting different corresponding functions.

The manual switches are used for adjusting two or more parameter values corresponding to two or more operating attributes of the driver circuit for the driver circuit to generate a corresponding driving current.

The parameter values may be directly or indirectly corresponding to the operating attributes. For example, one of the parameter value may be a value from multiple candidate values for indicating a mode from multiple candidate modes. When users operate the manual switch setting the parameter value, the driver circuit receives the parameter value and then translates the parameter value to one or more than one corresponding driver signals, to change working modes, to switch to another look-up tables for generating multiple sub-currents to multiple LED modules respectively for achieving different color temperatures, different colors, or to adjust one or more operation parameters. The affected parameters, with some examples mentioned above, based on which the driver circuit work are operating attributes of the driver circuit. Other behaviors may also be corresponded depending on design needs.

Other operating attributes may include, but not limited to, input voltages, input currents, output voltages, output currents, output duty ratios in PWM (Pulse Width Modulation), working modes, color temperatures, colors, light spectrums, blue light elimination, volume controls of a speaker integrated in the lighting module, luminance level or other direct or indirect attributes of the working behavior of the driver circuit and/or the lighting module.

The lighting module includes multiple LED modules and a lighting housing. The multiple LED modules are stored in the lighting housing. For example, the multiple LED modules are placed on a light source plate, a circular wall associated with a light guide component for guiding lights to desired output direction, one or more rigid or flexible elongated substrates as filament styles.

The multiple LED modules may be the same types or include multiple types. For example, the multiple LED modules may include red, blue, green LED modules. Furthermore, the multiple LED modules may include one type or more types of white LED modules. These LED modules may be operated exclusively, i.e. when a first set of LED modules are activated, the second set of LED modules are deactivated. In some other embodiments, all LED modules of different types are activated at the same time but with different light strengths for mixing different output lights.

The multiple LED modules are electrically coupled to the driver circuit of the driver box for receiving the driving current and for emitting a output light adjusted in response to operation of the at least two manual switches. Users may operate the two manual switches for adjusting the output light for meeting their needs.

When the lighting modules are installed in a cavity of a ceiling, the driver box is stored inside the cavity of the ceiling. In such case, even the manual switches are not easily operated unless the lighting module are detached from the cavity for exposing the manual switches to operate, there is still advantage for such design. For example, in a shopping mall, different color temperature types of lighting devices may be provided at the same time so that users may choose their desired types of lighting devices, e.g. a white light devices or a yellow light devices. With such design, users with different needs may buy the same type of light devices. What they need to do is to operate the manual switches to change the behavior of the lighting devices before installing the light devices to a ceiling.

Furthermore, lighting devices, particularly with LED modules, may have a long life span. People, in a factory, a store, or at home, may want to change their environment design, e.g. relocating spaces. In such case, they can use the old but well working lighting devices, and operate the manual switches for changing the behavior of the lighting devices.

In some embodiments, the lighting housing may include a panel frame defining a light opening for emitting the output light. In such case, the light module may be a rectangular, a circular, a polygonal shape of a panel light. To make the panel light thinner, a light guide may be used while LED modules emitting light into a lateral wall of the light guide and the light is directed to emit outside the light guide to produce a soft and comfortable light source.

In some embodiments, one of the manual switches is used for setting a color temperature of the output light. For example, the manual switch may be used for selecting one from several candidate values, e.g. morning light, sunset light, noon light, cold light, warm light corresponding to different color temperatures, as well as light strengths.

In some embodiments, one of the manual switches is used for setting a current value of the driving current supplied to the LED modules. The current value may include multiple sub-values for driving different LED modules respectively. These sub-values may be scaled at the same ratio or at different ratios. For example, there are two types of LED modules in the lighting module. When an overall driving current is increased, the first type of LED module may have a larger increasing ratio than the second type of LED module. With such design, the light characteristic is changed while the overall luminance level is changed.

In some embodiments, the luminance level of the output light is increased or decreased in response to one of the parameters. Specifically, such setting achieves a similar dimming function that is commonly used in current lighting design.

In some embodiments, one of the manual switches is used for setting a mixed color value of the output light. For example, when the LED modules include multiple colors, by changing luminance levels of these colors, a mixed color is obtained for satisfying different needs of users.

For example, in birthday parties, or Christmas holidays, a housing or a store may be decorated with different colors in that time period but may be restored to normal lighting setting when the holiday season is over. Such design provides a flexible and convenient use of lighting devices.

In some embodiments, an openable cover may be used for concealing the manual switches when the openable cover is closed. Such openable cover may have a sliding structure, a detachable structure, a rotatable structure or any other structure so that users may open and close the cover for exposing the manual switches to operate or for concealing the manual switches.

In some embodiments, one of the manual switches is a mode indicator for indicating one operating attribute from multiple operating attributes, and another manual switch is operated for changing the parameter value of the indicated operating attribute.

Specifically, two manual switches may be used for corresponding to different parameter value settings. Alternatively, one manual switch may be used for indicating which parameter value is to be corresponded. In such design, two manual switches may be used for setting more than two parameter values. For example, the first manual switch may be slided for selecting 10 setting modes indicating one from 10 parameter values to be adjusted by the other manual switch.

In some embodiments, more than three operating attributes are adjustable via the manual switches. As mentioned, more than two manual switches may be disposed on the driver box. Furthermore, these manual switches may have the same types or different types.

In some embodiments, the driver box is connected to the lighting module via a detachable connector. For example, detachable connector may contain multiple power wires for supplying electricity and control wires for transmitting control signals. In some other case, the driver box may be mounted directly on the light module or even integrated with the lighting housing of the lighting module. For example, such design may be used in downlight design.

In some embodiments, the driver box has multiple operating modes corresponding to different types of the lighting module. The same driver box may be used in different types of lighting modules. When different lighting modules are connected, the driver circuit may have different corresponding settings. With the manual switch for selecting corresponding configuration, the design may be simplified, e.g. the driver circuit does not need to reply on electronic detection of the lighting module for providing a corresponding driving current. In addition, when the driver circuit is configured to map to different types of lighting modules, more functions may be designed for one lighting module without interference with other lighting module.

In some embodiments, each manual switch corresponds to a different operating attribute when the driver box is connected to a different type of the light module. The driver circuit may determine the type of lighting module by auto detection or via the manual switch as mentioned above. In some embodiments, the manual switches may correspond to different parameter values associated with different operating attributes.

In some embodiments, the driver circuit in the driver box supplies power to multiple lighting modules. Specifically, multiple lighting modules may share the same driver circuit to decrease cost and/or decrease installation difficulty. In such case, the manual switch may indicate corresponding connection of the multiple lighting modules.

In some embodiments, the manual switch indicates a number of lighting modules being connected to the driver box. With such design, the driver circuit may provide different corresponding voltages and/or currents to the lighting modules. In some embodiments, a constant current source is disposed in the driver circuit and the overall current value may be adjusted depending on different number of lighting modules being connected to the driver circuit.

In some embodiments, the driver circuit works with another driver circuit in another driver box, and the parameter value indicates a working parameter with said another driver circuit. For example, multiple driver circuits may work together for supplying currents to LED modules. In some embodiments, some driver circuit may be kept in sleep and standby mode, and activated when necessary, e.g. a larger luminance level is requested. Such design may also be used for providing a backup mechanism so that when one driver circuit is out of order, the other driver circuit may provide temporary and backup function for keeping light modules to function normally or function with least capability.

In some embodiments, the driver circuit may include a detector for detecting a type of the light module and configures a corresponding mapping between the operating attributes and the manual switches according to the type of lighting module.

In such design, the driver circuit determines a current type of lighting module, different functions may be assigned to the same manual switch.

In some embodiments, even a manual switch is corresponding to color temperature adjustment, but the corresponding driving manners may be different when connecting to different lighting modules. For example, in a first mode, the manual switch corresponds adjustment of red, green and blue LED modules for adjusting color temperature of the output light. In a second mode, the same manual switch corresponds adjustment of two white LED modules with different color temperatures.

In some embodiments, the lighting apparatus may include a communication circuit for receiving an external command for adjusting the output light. For example, the communication circuit may implement Wi-Fi, Bluetooth, Zig-Bee or other IoT protocols for receiving and/or transmitting messages from and to an external remote control device, a server or a mobile phone. The parameter value is combined with the external command for determining a characteristic of the output light.

In some embodiments, the lighting apparatus may be provided with a replaceable unit to be detachably attached to the lighting module for adjusting the output light in different manners. For example, the replaceable unit may be a lens module. Different lens modules providing different light beam patterns may be provided to users so that users may replace a proper lens module when needed. In such case, the manual switches are used for driving the LED modules corresponding to the replaceable unit. For example, when a lens module with a focus mode is used, some LED modules are turned off, when in other case, another lens module with a wider beam angle is used, all LED modules are turned on.

In some embodiments, the replaceable units may be multiple lens set for producing light beams with different beam angles.

In some embodiments, the manual switches are corresponded to disable a function of the lighting module, instead of activating corresponding functions of the lighting module. For example, a speaker may be activated or de-activated by operating the manual switch.

In some embodiments, the LED modules of the lighting module include two white light LED modules with different color temperatures.

In some embodiments, the LED modules of the lighting module may include a red LED module, a blue LED module and a green LED module.

In some embodiments, the two white light modules, the red module, the blue module and the red module are packaged together as a package unit receiving the driving current from the driver circuit. Different packaging styles may be used for providing different integrated manner of different LED modules.

In some embodiments, at least one of the manual switches provide continuous adjusting of corresponding parameter value. Specifically, instead of discrete settings, a continuous value is set. For example, a parameter value between 0 to 1 is set with a manual switch, and in such case, 0.05, 0.93, 0.74, 0.5 or other arbitrary value may be set.

In some embodiments, the continuous adjusting is for light dimming of the output light.

In some embodiments, at least one of the manual switches provide segmental adjusting of corresponding parameter value. Segmeral adjusting, compared with continuous adjusting, provides multiple discrete values to be selected therefrom. Different types of manual switches are disposed at the same time for provide a more flexible way of setting possibility.

Figure 6:
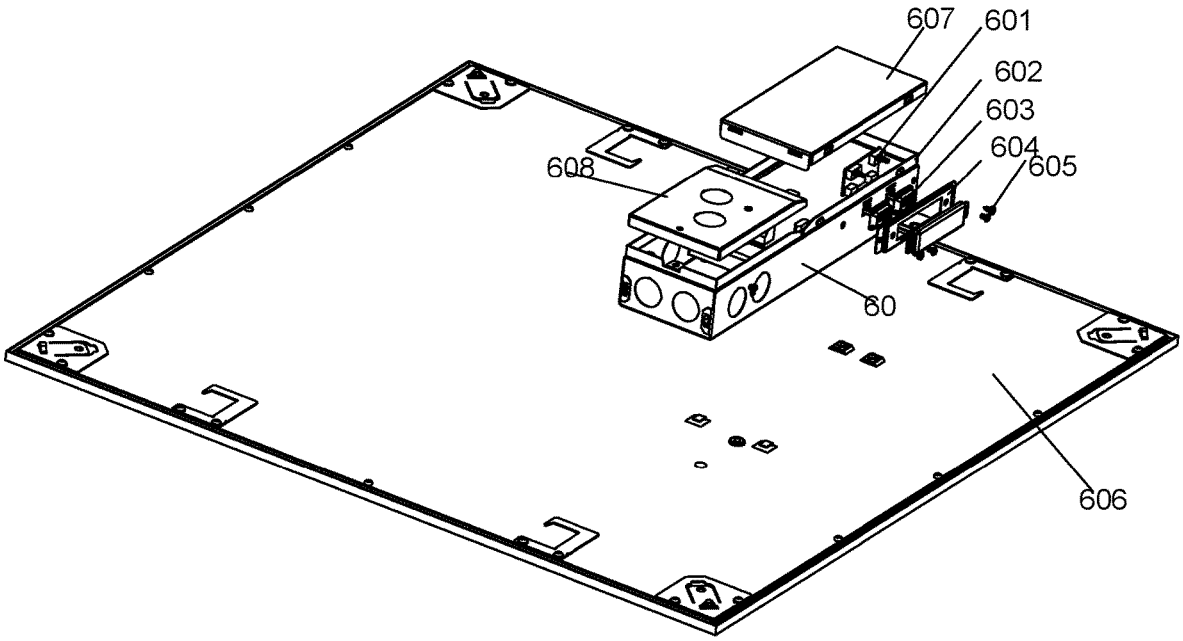
FIG. 6 illustrates a panel light embodiment.

Please refer to FIG. 6, which illustrates a panel light apparatus. In FIG. 6, the panel light apparatus includes a driver box 60 and a lighting module 606. The driver box 60 is mounted on a back cover of the lighting module 606.

The driver box has two covers 608, 607. The cover 607 is openable. There is a switch module 601 containing two manual switches. There are a wall 602 and two caps 603 for covering the manual switches for better operability. There is a frame 604 and screws 605 for forming the manual switch module.

Figure 7:
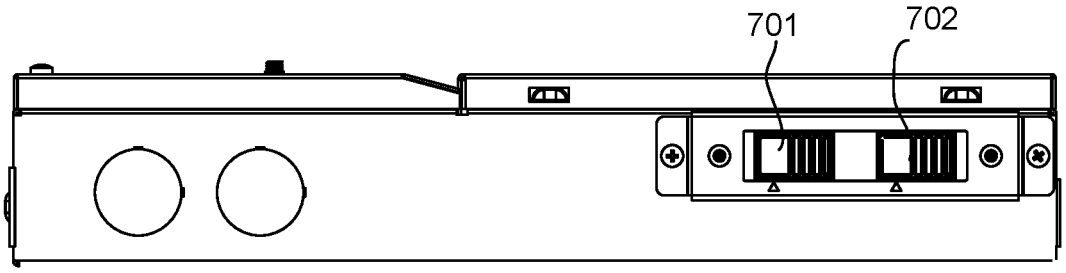
FIG. 7 illustrates a driver box used in the example of FIG. 6

Please refer to FIG. 7, which illustrates an enlarged diagram showing two manual switches 701, 702 that are slidable among several candidate parameter values.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A Lighting apparatus, comprising:

a driver box comprising a box housing, a driver circuit, and at least two manual switches, the driver circuit being stored in the box housing, the at least two manual switches being operable for setting at least two parameter values, the two parameter values corresponding to two operating attributes of the driver circuit for the driver circuit to generate a corresponding driving current;

a lighting module comprising multiple LED modules and a lighting housing, the multiple LED modules being stored in the lighting housing and being electrically coupled to the driver circuit of the driver box for receiving the driving current and for emitting an output light adjusted in response to operation of the at least two manual switches; and a replaceable unit having a lens to be detachably attached to the lighting module instead of the driver box for adjusting the output light in different manners, the manual switches being not disposed on the replaceable unit, the manual switches being used for indicating the driver circuit to driving the LED modules differently when the attached replaceable unit is different.

2. The Lighting apparatus of claim 1, wherein the lighting housing comprises a panel frame defining a light opening for emitting the output light.

3. The Lighting apparatus of claim 1, wherein one of the manual switches is used for setting a color temperature of the output light.

4. The Lighting apparatus of claim 1, wherein one of the manual switches is used for setting a current value of the driving current supplied to the LED modules.

5. The Lighting apparatus of claim 4, wherein the luminance level of the output light is increased or decreased in response to one of the parameters.

6. The Lighting apparatus of claim 1, wherein one of the manual switches is used for setting a mixed color value of the output light.

7. The Lighting apparatus of claim 1, further comprising an openable cover for concealing the manual switches when the openable cover is closed.

8. The Lighting apparatus of claim 1, wherein one of the manual switches is a mode indicator for indicating one operating attribute from multiple operating attributes, and another manual switch is operated for changing the parameter value of the indicated operating attribute.

9. The Lighting apparatus of claim 8, wherein more than three operating attributes are adjustable via the manual switches.

10. The Lighting apparatus of claim 1, wherein the driver box is connected to the lighting module via a detachable connector.

11. The Lighting apparatus of claim 10, wherein the driver box has multiple operating modes corresponding to different types of the lighting module.

12. The Lighting apparatus of claim 11, wherein each manual switch corresponds to a different operating attribute when the driver box is connected to a different type of the light module.

13. The Lighting apparatus of claim 1, wherein the driver circuit in the driver box supplies power to multiple lighting modules.

14. The Lighting apparatus of claim 13, wherein the manual switch indicates a number of lighting modules being connected to the driver box.

15. The Lighting apparatus of claim 13, wherein the driver circuit works with another driver circuit in another driver box, and the parameter value indicates a working parameter with said another driver circuit.

16. The Lighting apparatus of claim 1, wherein the driver circuit comprises a detector for detecting a type of the light module and configures a corresponding mapping between the operating attributes and the manual switches according to the type of lighting module.

17. The Lighting apparatus of claim 1, further comprising a communication circuit for receiving an external command for adjusting the output light, wherein the parameter value is combined with the external command for determining a characteristic of the output light.

18. The Lighting apparatus of claim 1, wherein the replaceable unit comprises multiple lens set for producing light beams with different beam angles.

19. The Lighting apparatus of claim 1, wherein the manual switches correspond to disable a function of the lighting module.

20. The Lighting apparatus of claim 1, wherein the LED modules of the lighting module comprise two white light LED modules with different color temperatures.

21. The Lighting apparatus of claim 20, wherein the LED modules of the lighting module comprise a red LED module, a blue LED module and a green LED module.

22. The Lighting apparatus of claim 21, wherein the two white light modules, the red module, the blue module and the red module are packaged together as a package unit receiving the driving current from the driver circuit.

23. The Lighting apparatus of claim 1, wherein at least one of the manual switches provide continuous adjusting of corresponding parameter value.

24. The Lighting apparatus of claim 23, wherein the continuous adjusting is for light dimming of the output light.

25. The Lighting apparatus of claim 23, wherein at least one of the manual switches provide segmental adjusting of corresponding parameter value.

* * * * *